United States Patent [19]

McCallion et al.

[11] Patent Number: 4,655,782

[45] Date of Patent: Apr. 7, 1987

[54] BLEACH COMPOSITION OF DETERGENT BASE POWDER AND AGGLOMERATED MANGANESE-ALLUMINOSILICATE CATALYST HAVING PHOSPHATE SALT DISTRIBUTED THEREBETWEEN

[75] Inventors: Elizabeth J. McCallion, Hasbrouck Heights, N.J.; William Karpusiewicz, Floral Park, N.Y.; Charles F. Irwin, Randolph, N.J.

[73] Assignee: Lever Brothers Company, New York, N.Y.

[21] Appl. No.: 805,531

[22] Filed: Dec. 6, 1985

[51] Int. Cl.[4] ..... C11D 3/04; C11D 3/12; C11D 3/395; D06L 3/02

[52] U.S. Cl. ..... 8/111; 252/95; 252/96; 252/97; 252/99; 252/102; 252/133; 252/140; 252/174.17; 252/186.25; 252/186.27; 252/186.3; 252/186.43

[58] Field of Search ..... 252/95, 99, 102, 96, 252/174.17, 174.25, 186.38, 186.37, 97; 8/111

[56] References Cited

U.S. PATENT DOCUMENTS

| | | | |
|---|---|---|---|
| 3,398,096 | 6/1968 | Das et al. | 252/95 |
| 3,532,634 | 10/1970 | Woods | 252/95 |
| 3,789,002 | 1/1974 | Weber | 252/99 |
| 4,096,081 | 6/1978 | Phenicie | 252/140 |
| 4,184,975 | 1/1980 | Krings | 252/140 |
| 4,231,887 | 11/1980 | Denny | 252/174.19 |
| 4,261,941 | 4/1981 | Sherman | 264/117 |
| 4,288,340 | 9/1981 | Dankworth | 252/99 |
| 4,386,024 | 5/1983 | Maurer | 252/523 |
| 4,414,130 | 11/1983 | Cheng | 252/140 |
| 4,430,246 | 2/1984 | Sorbe | 252/140 |
| 4,444,674 | 4/1984 | Gray | 252/95 |
| 4,478,733 | 10/1984 | Oakes | 252/99 |
| 4,481,129 | 11/1984 | Oakes | 252/186.41 |
| 4,488,980 | 12/1984 | Oakes | 252/99 |
| 4,536,183 | 8/1985 | Namnath | 8/107 |
| 4,601,845 | 7/1986 | Namnath | 252/99 |

FOREIGN PATENT DOCUMENTS

| | | |
|---|---|---|
| 25608 | 3/1981 | European Pat. Off. . |
| 57088 | 8/1982 | European Pat. Off. . |
| 70079 | 1/1983 | European Pat. Off. . |
| 72166 | 2/1983 | European Pat. Off. . |

*Primary Examiner*—Dennis L. Albrecht

*Attorney, Agent, or Firm*—Milton L. Honig; James J. Farrell

[57] ABSTRACT

A bleaching composition is disclosed wherein the bleach catalyst is an aggregate comprising manganese (II) cations adsorbed onto an aluminosilicate support, a binder and a phosphate salt; the aggregates have a diameter ranging from at least 250 to about 2000 microns which aggregates upon dispersion in water for two minutes at pH 10 and 40° C. leave undissolved less than 5% particles of 125 microns or higher. The base detergent powder comprises a phosphate salt and a peroxy compound. It was found that bleach performance improves by having phosphate salt both in the aggregate and in the detergent powder base.

20 Claims, No Drawings

BLEACH COMPOSITION OF DETERGENT BASE POWDER AND AGGLOMERATED MANGANESE-ALLUMINOSILICATE CATALYST HAVING PHOSPHATE SALT DISTRIBUTED THEREBETWEEN

BACKGROUND OF THE INVENTION

1. Field of the Invention

The invention relates to manganese activated peroxygen bleach compositions with improved bleaching performance.

2. The Prior Art

Dry bleaching powders, such as those for cleaning laundry, generally contain inorganic persalts as the active component. These persalts serve as a source of hydrogen peroxide. Normally, persalt bleach activity in aqueous solution is undetectable where temperatures are less than 100° F. and delivery dosages less than 100 ppm active oxygen. The art has recognized, however, that bleaching under mild conditions may be effectuated through the use of activators. In particular, manganese (II) salts have been reported to be exceptionally effective in activating persalts under mild conditions.

Attempts to improve the bleach activity of manganese (II) salts have been reported. U.S. Pat. No. 4,481,129 discloses bleach compositions containing manganese (II) salts in conjunction with carbonate compounds. U.S. Pat. No. 4,478,733 describes bleach compositions containing manganese (II) salts in conjunction with aluminosilicate cation-exchange materials. U.S. Pat. No. 4,488,980 reports a bleach beneficial interaction between a condensed phosphate/alkali metal orthophosphate mixture and manganese (II) salts.

There are, unfortunately, several problems associated with heavy metal salts. Storage instability is particularly acute. These salts accelerate wasteful peroxide decomposition reactions that are non-bleach effective. Under alkaline conditions, as when used with laundry cleaning compositions, metal cations undergo irreversible oxidation and no longer catalyze. Perversely, the peroxide bleaching reaction is most effective at high pH.

In European Pat. No. 0 072 166, it was proposed to pre-complex catalytic heavy metal cations with a sequestrant and dry-mix the resultant product, in particulate form, with the remainder of the peroxygen containing detergent composition. Storage stability was found to be thereby improved. The patent notes that the complex of catalytic heavy metal cation and sequestrant can be agglomerated in a matrix of pyrophosphates, orthophosphates, acid orthophosphates and triphosphates.

Another problem with manganese (II) cations occurs when they are utilized for whitening laundry. Strong oxidants, such as hypochlorites, are frequently included in laundry washes. Manganese ions will react with these strong oxidants to form manganese dioxide. This compound is highly staining toward fabrics.

Stain problems resulting from free manganese ions have been reduced by binding the heavy metal ion to a water-insoluble support. Thus, European Patent Application No. 0 025 608 reveals a peroxide decomposition catalyst consisting of zeolites or silicates whose cations have been exchanged for heavy metals such as manganese. Co-pending U.S. application Ser. No. 597,971, now U.S. Pat. No. 4,536,183 discloses an activator comprising a water-soluble manganese (II) salt adsorbed onto a solid inorganic silicon support material, the combination having been prepared at a pH from 7.0 to 11.1.

While the foregoing systems provide adequate bleaching and improved stain prevention, there still remain several other problem areas. The prior art catalyst particles are generally in the form of fine powders. When blended with detergent granules, the catalyst powders are easily segregated falling to the bottom of the detergent package. A co-pending U.S. application Ser. No. 805,530 reports solving the foregoing problem by forming aggregated granules prepared by agglomerating, with a binder, a catalyst combination of manganese (II) cation adsorbed onto an aluminosilicate support material. The resultant particles have diameters ranging from at least 250 to 2000 microns. Co-pending U.S. application Ser. No. 668,536 provides a somewhat analogous solution by binding manganese (II) cations to a "ligand" such as zeolite to form a complex. This complex is then protectively enclosed in a matrix of water-soluble or water-displaceable materials. Examples of suitable matrices include modified starch, polyvinyl pyrrolidone, polyvinyl alcohol, sodium carboxymethyl cellulose and glassy phosphates.

Even with all the above-noted advances, non of the art has provided a catalyst system meeting all criteria including those of non-staining, storage stability and commercially acceptable bleach activity.

Accordingly, it is an object of the present invention to provide a bleach formulation based on manganese catalysis of peroxygen compounds that is non-staining and provides improved package storage stability while rapidly releasing active manganese/aluminosilicate particles upon dispersion in water.

Another object of this invention is to provide a manganese catalyst in aggregate form that exhibits enhanced bleaching performance. A further object of this invention is to provide an improved method for bleaching substrates, especially fabrics.

SUMMARY OF THE INVENTION

A bleaching composition is provided comprising:

(a) from about 1 to 20% of a bleach catalyst in aggregate form, exclusive of any peroxy compound precursor within the aggregate, comprising:
  (i) from 0.5 to 95% of a manganese (II) cation adsorbed onto an aluminosilicate support material, said support having an average diameter size of about 2 to 10 microns, the ratio of manganese (II) cation to aluminosilicate support material ranging from about 1:1000 to 1:10;
  (ii) from about 0.1 to 40% of a binder, the amount based on a dry solids weight content of the total aggregate; and
  (iii) from about 10 to 80% of a phosphate salt, the amount based on a dry solids weight content of the total aggregate;

wherein at least 75% of said aggregates have a diameter ranging from at least 250 to about 2000 microns, said catalyst also leaving undissolved less than 5% particles of diameter 125 microns or higher when dispersed in water for two minutes at pH 10 and 40° C., and wherein neither the aggregates nor their components have a pH of more than 10;

(b) a base detergent powder comprising:
  (i) from about 1 to 80% of a phosphate salt; and
  (ii) from 0.5 to 50% of a peroxy compound.

DETAILED DESCRIPTION OF THE INVENTION

Phosphates are known to improve bleach performance in manganese catalyzed systems. Now it has been discovered that the location of the phosphate salt is important. In the prior art, phosphates have been incorporated into the base detergent powder. It is herein shown that substantial advantages accrue when a portion of phosphate is placed in the catalyst aggregate and another portion in the base powder. The ratio of phosphate in the base powder to that in the granule should range from about 20:1 to about 1:20; preferably from about 5:1 to 1:20; more preferably from about 3:1 to 1:10; and most preferably from about 1:1 to about 1:5.

Suitable phosphate salts for both aggregate granule and base powder include the alkali metal salts of tripolyphosphate, orthophosphate and pyrophosphate. In aqueous solution, the phosphate salt level should be at least 10 ppm, the ratio of phosphate to peroxy compound being from about 10:1 to 1:10.

The bleach catalyst granules include an aluminosilicate support material which must be one having an average particle diameter size of about 2 to 10 microns (a very fine powder). Larger diameter aluminosilicate particles would have a smaller overall surface area. These would not be as reactive. It has been herein noted that while finely powdered aluminosilicate is catalytically active in the wash, the fine powder segregates in the package and adversely interacts with peroxygen compounds upon storage. Aggregation of finely powdered aluminosilicate into larger granules has solved the problem of segregation and storage instability.

Particle sizes of the catalyst aggregates have been found to be very important. At least 75% of the aggregates must have a diameter ranging from at least 250 to about 2000 microns. Preferably, aggregate diameters should range from 500 to 1500 microns, more preferably 900 to 1200 microns.

Among the aluminosilicates, synthetic zeolites are particularly suitable as the support material. Preferred are those zeolites designated as A and 13X type. These zeolites are sold by the Union Carbide Corporation under the designation ZB-100 and ZB-400, respectively. ZB-100 and ZB-400 have average pore sizes of 4 and 10 Angstroms, respectively. Additional sources of these zeolites are Crosfields, Ltd., Philadelphia Quartz, Huber and Ethyl Corporations.

Another type of suitable support material is the silicoalumino phosphates (SAPOs). These materials are also commercially available from Union Carbide. SAPOs have a wide range of compositions within the general formula $0–0.3R(Si_xAl_yP_z)O_2$ where x, y and z represent the mole fractions of Si, Al and P, respectively. The range for x is 0.01 to 0.98, for y from 0.01 to 0.60, and for z from 0.01 to 0.52. R refers to the organic template that is used to develop the structure of the particular SAPO. Typical templates used in preparing SAPOs are organic amines or quaternary ammonium compounds. Included within the SAPO family are structural types such as $AlPO_4$-16, Sodalite, Erionite, Chabazite, $AlPO_4$-11, Novel, $AlPO_4$-5 and Faujasite.

The manganese used in the present invention can be derived from any manganese (II) salt which delivers manganous ions in aqueous solution. Manganous sulfate and manganous chloride or complexes thereof, such as manganous triacetate, are examples of suitable salts.

Finished catalyst will contain from about 0.1% to about 5.5% manganese (II) per weight of solid support. Preferably, the amount of manganese (II) is from about 1 to about 2.5%, this amount being defined on a dry basis as [Mn/(anhydrous support+Mn)]. When dispersed in water, the catalyst should deliver a minimum level of 0.5 ppm manganese (II) ion to the aqueous solution. For instance, if a catalyst has 1 weight % of manganese then there is required at least 50 milligrams catalyst per liter of aqueous solution.

The catalyst and compositions of this invention may be applied to either flexible or hard substrates such as fabrics, dishes, dentures, tiles, toilet bowls and ceramic floors. Flexible substrates, specifically fabrics, will, however, be focused upon in the subsequent discussion.

A binder is an essential element of the catalyst aggregates. It will be present from about 0.1 to 40% by weight of the aggregate, preferably from about 5 to 20; ideally from about 5 to 10%. The binder is a water-soluble, water-dispersible material, preferably organic, and will have a pH no higher than 10, preferably less than 9.5 and more preferably less than 7. Binders may be selected from organic homo-polymers or hetero-polymers, examples of which are starches, cellulose ethers, gums and sugars. Long chain $C_{10}$–$C_{22}$ fatty acids and fatty acid soaps may also be suitable binders. Inorganic materials may be used as binders if they meet the pH limitation of no greater than 10 and other limitations as herein provided. Illustrative of this category are the so-called glassy sodium phosphates of the molecular structure: $Na_2O_4P[NaO_3P]_nPO_3Na_2$, wherein the average value of n is from about 10 to 30. Silicates are unacceptable as binders because their pH is greater than 10.

Starches are preferred because of their very favorable combination of good binding and fast water dispersing properties. Starches usually occur as discrete particles or granules having diameters in the 2 to 115 micron range. While most starches contain from 22 to 26% amylose and 70 to 74% amylopectin, some starches, such as waxy cornstarches, may be entirely free of amylose. It is intended to include within the term "starch" the various types of natural starches, including corn starch, potato starch, tapioca, cassava and other tuber starches, as well as amylose and amylopectin separately or in mixtures. Furthermore, it is also intended that such term stand for hydroxy-lower alkyl starches, hydroxyethyl starch, hydroxylated starches, starch esters, e.g., starch glycolates and other derivatives of starch having essentially the same properties.

Several modified starches are particularly preferred as binders. These include Nadex 320®, a white corn dextrin of low viscosity, and Capsul®, a waxy dextrin hydrophobic derivative, also of low viscosity. Nadex 320® and Capsul® are commercially available from The National Starch and Chemical Company, Bridgewater, N.J.

Gums and mucilages are carbohydrate polymers of high molecular weight, obtainable from plants or by synthetic manufacture. Among the plant gums that are of commercial importance may be mentioned arabic, ghatti, karaya and tragacanth. Guar, linseed and locust bean are also suitable. Seaweed mucilages or gums such as agar, align and carageenan are also within the binder definition.

Among the synthetic gums that are the most favored are the carboxymethyl celluloses such as sodium carboxymethyl cellulose. Other cellulose ethers include hydroxypropyl cellulose, methyl and ethyl celluloses, hydroxypropyl methyl cellulose and hydroxyethyl cellulose.

Among the organic homo-polymers and heteropolymers are a multiplicity of materials. Commercially available water soluble polymers include polyvinylpyrrolidone, carboxyvinyl polymers such as the Carbopol® sold by B. F. Goodrich Chemical Company and the polyethylene glycol waxes such as Carbowax® sold by the Union Carbide Corporation. Polyvinyl alcohol and polyacrylamides are further examples.

Polyvinylpyrrolidone is a particularly useful binder. Commercially, it is available from the GAF Corporation under the designation PVP K-15, K-30, K-60 and K-90. These products differ in their viscosity grades, the number average molecular weights being about 10,000, 40,000, 60,000 and 360,000, respectively. PVP K-30 and K-60 are the preferred binders.

When modified starches are employed as the binder, they can be incorporated at levels up to about 40% of the total granule weight. Although acceptable granules can be obtained with modified starches at 5–10% concentration levels, it has been found that at higher binder levels the dispersion rate increases compared to the 5–10% levels. The effect is similar with polyvinyl pyrrolidone.

Binders within the definition of this invention must hold together the aluminosilicate particles in an agglomerate that is free-flowing and non-sticky. Free-flow properties may be measured by the DFR test as outlined in U.S. Pat. No. 4,473,485 (Greene), herein incorporated by reference. Furthermore, suitable binders are those which provide for coherent agglomerates difficult to crush under ordinary finger pressure.

Another major criterion identifying both binder and resultant agglomerates is their readiness to disperse in water. A Dispersion Test for evaluation of this property has been devised which provides good reproducibility. The percent non-dispersible particles are determined by placing 5 grams of sample agglomerate in 500 milliliters deionized water held at 40° C. and at a pH of 10. After stirring for two minutes, the solution is drained through a 120 micron diameter screen. Subsequently, the screen is dried and weighed. Less than 5% by weight of the original sample should remain on the screen. Greater amounts are deemed unacceptable. Failure to adequately de-agglomerate in water means the active manganese (II) on zeolite catalyst will not, to its fullest extent, desorb and contact the peroxygen compound. Bleaching efficiency is thereby impaired.

Besides the agglomerated manganese (II) adsorbed aluminosilicate particles, a peroxide source is necessary. Suitable peroxy compounds include the inorganic persalts which liberate hydrogen peroxide in aqueous solution. These may be water-soluble perborates, percarbonates, perphosphates, persilicates, persulfates and organic peroxides. Amounts of peroxy compound in the dry bleach powder should range from about 5 to about 30%. At least 10 ppm, preferably 30 ppm or greater, active oxygen should be delivered by the persalt to a liter of wash water. For instance, with sodium perborate monohydrate, this represents a minimum amount of 200 mg per liter of wash water.

Peroxy compound precursors such as those described in U.S. Pat. No. 4,444,674 (Gray), the disclosure of which is incorporated herein by reference, are to be absent from the present formulations and aggregates. Manganese (II) cations are sufficient to activate bleaching by peroxy compounds. In fact, the combination of manganese cations and peroxy precursor may be bleach inhibiting.

The ratio of active oxygen generated by peroxy compound to manganese (II) ion in aqueous solution ranges from about 1000:1 to 1:1000, preferably 1000:1 to 1:10.

Surface active detergents may be present in an amount from about 0.5% to about 50% by weight, preferably from 5% to 30% by weight. These surface active agents may be anionic, nonionic, zwitterionic, amphoteric, cationic or mixtures thereof.

Among the anionic surfactants are water-soluble salts of alkylbenzene sulfonates, alkyl sulfates, alkyl ether sulfates, paraffin sulfonates, α-olefin sulfonates, α-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and β-alkoxyalkane sulfonates. Soaps are also useful as anionic surfactants.

Nonionic surfactants are water-soluble compounds produced, for instance, by the condensation of ethylene oxide with a hydrophobic compound such as an alkanol, alkyl phenol, polypropoxy glycol or polypropoxy ethylene diamine.

Cationic surface active agents include the quaternary ammonium compounds having 1 or 2 hydrophobic groups with 8–20 carbon atoms, e.g., cetyl trimethylammonium bromide or chloride, and dioctadecyl dimethylammonium chloride.

A further exposition of suitable surfactants for the present invention appears in "Surface Active Agents and Detergents", by Schwartz, Perry & Berch (Interscience, 1958), the disclosure of which is incorporated herein by reference.

Detergent builders may be combined with the bleach compositions. Useful builders can include any of the conventional inorganic and organic water-soluble builder salts. Typical of the well known inorganic builders are the sodium and potassium salts of the following: pyrophosphate, tripolyphosphate, orthophosphate, carbonate, bicarbonate, silicate, sesquicarbonate, borate and aluminosilicate. Among the organic detergent builders that can be used in the present invention are the sodium and potassium salts of citric acid and nitrilotriacetic acid. These builders can be used in an amount from 0 up to about 80% by weight of the composition, preferably from 10% to 50% by weight.

Apart from detergent active compounds and builders, compositions of the present invention can contain all manner of minor additives commonly found in laundering or cleaning compositions in amounts in which such additives are normally employed. Examples of these additives include: lather boosters, such as alkanolamides, particularly the monoethanolamides derived from palm kernel fatty acids and coconut fatty acids; lather depressants, such as alkyl phosphates, waxes and silicones; fabric softening agents; fillers; and usually present in very minor amounts, fabric whitening agents, perfumes, enzymes, germicides and colorants.

The bleach catalyst agglomerates are prepared by combining manganese (II) cations, aluminosilicate support material and the binder in an apparatus that provides a high disruptive force to the mixture. A high disruptive force is one imparting high impact against particles as they agglomerate to curtail their growth. The disruptive force minimizes the accumulation of oversized granules. One technique to impart a high disruptive force is by use of a metal surface that runs through the bed of agglomerated mass at high velocity. Illustrative of such metal surfaces are the intensifier ("beater") bar or rotating rotor tool as found in a Patterson-Kelly Twin Shell Blender and Eirich RV02 Mixer respectively.

Agglomerated particles resulting from the granulation process must be dried to remove water. Less than about 12% water should remain in the final dried agglomerated particles. If greater amounts of water are present, they will adversely interact with peroxy compounds to destabilize them. The peroxides will decompose at a greater rate during storage.

The following examples will more fully illustrate the embodiments of the invention. All parts, percentages and proportions referred to herein and in the appended claims are by weight unless otherwise indicated.

EXAMPLE 1

Catalyst Preparation

A total of 5000 grams manganous chloride tetrahydrate were dissolved in 100 liters of distilled water. A separate vessel was charged with a slurry of 100 kilograms zeolite (Crosfields DB10) in 102 liters of water. The slurry pH was adjusted to between 9.0 and 9.5 with sulfuric acid. The manganese solution was fed into the zeolite slurry. Exchange was allowed for 45 minutes.

An Eirich Intensive Mixer (Model RV 02) was charged with 3 kilograms of the dried manganese exchanged on zeolite, with sodium tripolylphosphate (see following Examples for amounts) and with 1.153 kilograms of a 25% (by weight) aqueous PVP K-30 solution. The Eirich rotor and pan were operated at 26.2 meters/sec. tip speed and 65 rpm, respectively. Water was added throughout the batch operation until a total moisture level of about 35% was reached. Agglomeration was observed to occur between about 3 to 8 minutes into the blending, the time being dependent upon the amount and timing of water addition.

Thereafter, the agglomerated product was dried in a Aeromatic STREA-1 fluid bed dryer (manufactured by the Aeromatic Corporation). Target moisture level was 12.5% water or less. The original khaki color of the starting zeolite changed to antique white after being dried to the proper moisture level.

EXAMPLE 2

Several model formulations were prepared to evaluate the effects of different amounts of sodium tripolyphosphate in the base powder and in the catalyst granules. Table I outlines the formulation.

TABLE I

| Model Formulation | |
|---|---|
| Component | Weight % |
| Sodium carbonate | 54 |
| Sodium perborate monohydrate | 27 |
| Aggregated catalyst granule (manganese II on zeolite)* | 7 |
| Sodium tripolyphosphate** | 12 |

*prepared according to Example 1.

**distribution of phosphate varies according to Table II with total level constant at 12%.

TABLE II

| Bleach Performance Results | | | |
|---|---|---|---|
| Relative Amounts of Sodium Tripolyphosphate | | ΔR Bleach Performance | |
| STP in Powder | STP in Catalyst Granule | 60 ppm | 120 ppm* |
| 100 | 0 | 6.6 | 8.2 |
| 55 | 45 | 10.1 | 10.6 |
| 50 | 50 | 10.7 | 11.3 |
| 38 | 62 | 11.2 | 11.6 |

*refers to water hardness.

Bleaching tests were conducted with a 4 pot Terg-O-Tometer from the U.S. Testing Company. Wash solutions were prepared from distilled water with hardness ions added to provide 60 ppm and 120 ppm of calcium and magnesium (2:1) on a calcium carbonate basis. The wash volume was 1 liter. Temperature was maintained at 40° C. Agitation was provided throughout a 14 minute wash period.

Bleaching was monitored by measuring reflectance of a dry cotton cloth (4"×6"). Prior to bleaching, the cloth had been uniformly stained with a tea solution and washed several times in a commercial detergent. Reflectance was measured on a Gardner XL-23 Reflectometer. Bleach performance is reported as ΔR, higher values indicating improved performance.

The data listed in Table II indicates the advantage from positioning sodium tripolyphosphate in both the base powder and within the agglomerated catalyst granules. This effect appears to be independent of water hardness as shown by the nearly equivalent results at 60 and 120 ppm hardness.

EXAMPLE 3

Experiments similar to that illustrated in Example 2 were performed using fully formulated detergent products. These detergent products are outlined in Table III. The amounts of agglomerated catalyst granules and base powder were held at 12% and 88% of total formulation, respectively.

TABLE III

| Detergent Powder Formulations | | | | |
|---|---|---|---|---|
| | Samples (Weight %) | | | |
| | 1 | 2 | 3 | 4 |
| Detergent Base Powder | | | | |
| Alkylbenzene sulfonate | 8 | 8 | 9 | 9 |
| Ethoxylated $C_{12}$–$C_{15}$ alcohol sulfate | 4 | 4 | 4.5 | 4.5 |
| Sodium carbonate | 37 | 37 | 36 | 36 |
| Sodium tripolyphosphate | 13 | 6 | 2 | 6 |
| Sodium perborate | 23 | 23 | 22 | 22 |
| Adjunct detergent additives | | | to 100 | |
| Agglomerated Catalyst Granules | | | | |
| Manganese (II) adsorbed on zeolite | 8 | 8 | 9 | 9 |
| Sodium tripolyphosphate | 0 | 7 | 6 | 2 |
| Water | 3 | 3 | 5 | 5 |
| Bleaching Performance | | | | |
| ΔR | 3.8 | 8.5 | 12.8 | 9.8 |

It is evident from Table III that incorporation of sodium tripolyphosphate in the base powder alone is less effective than when located in both base powder and catalyst granule. Furthermore, it appears more important to incorporate sodium tripolyphosphate in the catalyst granule than in the base powder as seen from the results of Samples 3 and 4, the former having a better bleaching effect.

The foregoing description and Examples illustrate selected embodiments of the present invention and in light thereof variations and modifications will be suggested to one skilled in the art, all of which are in the spirit and purview of this invention.

What is claimed is:

1. A bleaching composition comprising:

(a) from about 1 to 20% of a bleach catalyst in aggregate form, exclusive of any peroxy compound precursor within the aggregate, comprising:

(i) from 0.5 to 95% of a manganese (II) cation adsorbed onto an aluminosilicate support material, said support having an average diameter size of about 2 to 10 microns, the ratio of manganese (II) cation to aluminosilicate support material ranging from about 1:1000 to 1:10;

(ii) from about 10 to 80% of a phosphate salt selected from the group consisting of tripolyphosphate, orthophosphate, pyrophosphate and mixtures thereof; and (iii) from about 0.1 to 40% of a binder, the amount based on a dry solids weight content of the total aggregate, said binder being different from said phosphate salt;

wherein at least 75% of said aggregates have a diameter ranging from at least 250 to about 2000 microns, said catalyst also leaving undissolved less than 5% particles of diameter 125 microns or higher when dispersed in water for two minutes at pH 10 and 40° C., and wherein neither the aggregates nor their components have a pH of more than 10;

(b) a base detergent powder comprising:

(i) from about 1 to 80% of a phosphate salt; and (ii) from 0.5 to 50% of a peroxy compound.

2. A bleach composition according to claim 1 wherein the phosphate is sodium tripolyphosphate.

3. A bleach composition according to claim 1 wherein the ratio of phosphate in the base detergent powder to that in the catalyst granule ranges from about 20:1 to 1:20.

4. A bleach composition according to claim 1 wherein the ratio of phosphate in the base detergent powder to that in the catalyst granules ranges from about 2:1 to 1:20.

5. A bleach composition according to claim 1 wherein the peroxy compound is sodium perborate.

6. A bleach composition according to claim 1, wherein the particle diameter size ranges from 500 to 1500 microns.

7. A bleach composition according to claim 1, wherein the binder is selected from the group consisting of starches, cellulose ethers, gums and sugars.

8. A bleach composition according to claim 1, wherein the binder is a long chain $C_{10}$–$C_{22}$ fatty acid or soap thereof.

9. A bleach composition according to claim 1, wherein the binder is a modified starch.

10. A bleach composition according to claim 1, wherein the binder is polyvinylpyrrolidone.

11. A bleach composition according to claim 9, wherein the modified starch is present from about 15 to about 40%.

12. A bleach composition according to claim 1, wherein the aluminosilicate support material is a synthetic zeolite having a pore size of from about 4 to about 10 Angstroms.

13. A bleach composition according to claim 1, wherein the aluminosilicate support material is a silicoalumino phosphate.

14. A bleach composition according to claim 1, wherein the amount of manganese (II) cation is present from about 1 to about 2.5% per weight, on a dry solids basis, of aluminosilicate support material.

15. A bleach composition according to claim 1 further comprising from about 0.1 to 98% of laundry detergent adjuncts selected from the group consisting of surfactants, builders, fabric softeners, enzymes, inorganic fillers, colorants, lather boosters and mixtures thereof.

16. A bleach composition according to claim 1 further comprising from about 0.5 to about 50% of a surface active agent.

17. A method for bleaching a substrate comprising placing the substrate into water and treating with the composition of claim 1.

18. A method according to claim 17 wherein the peroxy compound is present in an amount to deliver at least 10 mg active oxygen per liter to the wash solution and the bleach catalyst granules deliver at least 0.5 ppm manganese (II) cation per liter wash solution.

19. A method according to claim 17 wherein the phosphate is present in an amount to deliver from about 0.05 to 0.30 grams per liter wash solution.

20. A method according to claim 17 wherein the substrate is selected from fabrics, dishes, dentures, tiles, toilet bowls and ceramic floors.

* * * * *

UNITED STATES PATENT AND TRADEMARK OFFICE

CERTIFICATE OF CORRECTION

PATENT NO. : 4,655,782

DATED : April 7, 1987

INVENTOR(S) : McCallion et al.

It is certified that error appears in the above—identified patent and that said Letters Patent is hereby corrected as shown below:

In the Title, on title page [54] and column 1, line 4, replace "MANGANESE-ALLUMINOSILICATE" with -- MANGANESE-ALUMINOSILICATE --.

Column 2, line 25, replace "non" with -- none --.

Signed and Sealed this

Twenty-eighth Day of July, 1987

*Attest:*

DONALD J. QUIGG

*Attesting Officer*

*Commissioner of Patents and Trademarks*